109-82 SR
8/25/87 XR 4,688,493

United States Patent [19]

Brush, Jr. et al.

[11] Patent Number: 4,688,493

[45] Date of Patent: Aug. 25, 1987

[54] VAPOR-SEALED INSULATION SYSTEM FOR FIRE RESISTANT SAFE

[75] Inventors: John D. Brush, Jr., Webster; Patrick J. Beattie, Henrietta, both of N.Y.

[73] Assignee: John D. Brush & Co., Inc., Rochester, N.Y.

[21] Appl. No.: 625,835

[22] Filed: Jun. 28, 1984

[51] Int. Cl.[4] ..... E04F 5/00; E04F 5/16

[52] U.S. Cl. ..... 109/65; 109/82; 220/4 E; 52/79.13

[58] Field of Search ..... 109/65, 29, 82, 83, 109/84; 220/4 E, 4 B; 52/79.4, 79.7, 309.9, 743, 79.13; 264/46.5, 46.6

[56] References Cited

U.S. PATENT DOCUMENTS

| | | | |
|---|---|---|---|
| Re. 15,529 | 1/1923 | Dick et al. | 109/29 |
| 773,269 | 10/1904 | Vanderman | 109/75 |
| 1,342,204 | 7/1920 | Dick et al. | 109/29 |
| 1,749,222 | 3/1930 | Merriam | 109/74 |
| 2,586,873 | 2/1952 | Siple | 109/29 |
| 3,746,204 | 7/1973 | Nagai | 220/4 E |
| 3,775,919 | 12/1973 | Fulton et al. | 52/79.13 |
| 4,048,926 | 9/1977 | Brush, Jr. et al. | 109/65 |
| 4,057,283 | 11/1977 | Barnett | 220/4 E |
| 4,269,890 | 5/1981 | Breitling et al. | 264/46.6 |
| 4,422,386 | 12/1983 | Carpenter | 109/65 |

*Primary Examiner*—Gary L. Smith
*Assistant Examiner*—Neill Wilson
*Attorney, Agent, or Firm*—Stonebraker, Shepard & Stephens

[57] ABSTRACT

A vapor-sealed insulation system 10 for a fire resistant safe with a steel outer body 11 and door cover 12 uses several resin molds 15–17 that receive and hold the safe's insulation material and are shaped to fit within door 12 and body 11 for lining the safe's interior. The molds 15–17 not only preform the insulation but seal in its moisture. When the insulation molds are installed in the safe, their inner walls form interior safe surfaces.

13 Claims, 4 Drawing Figures

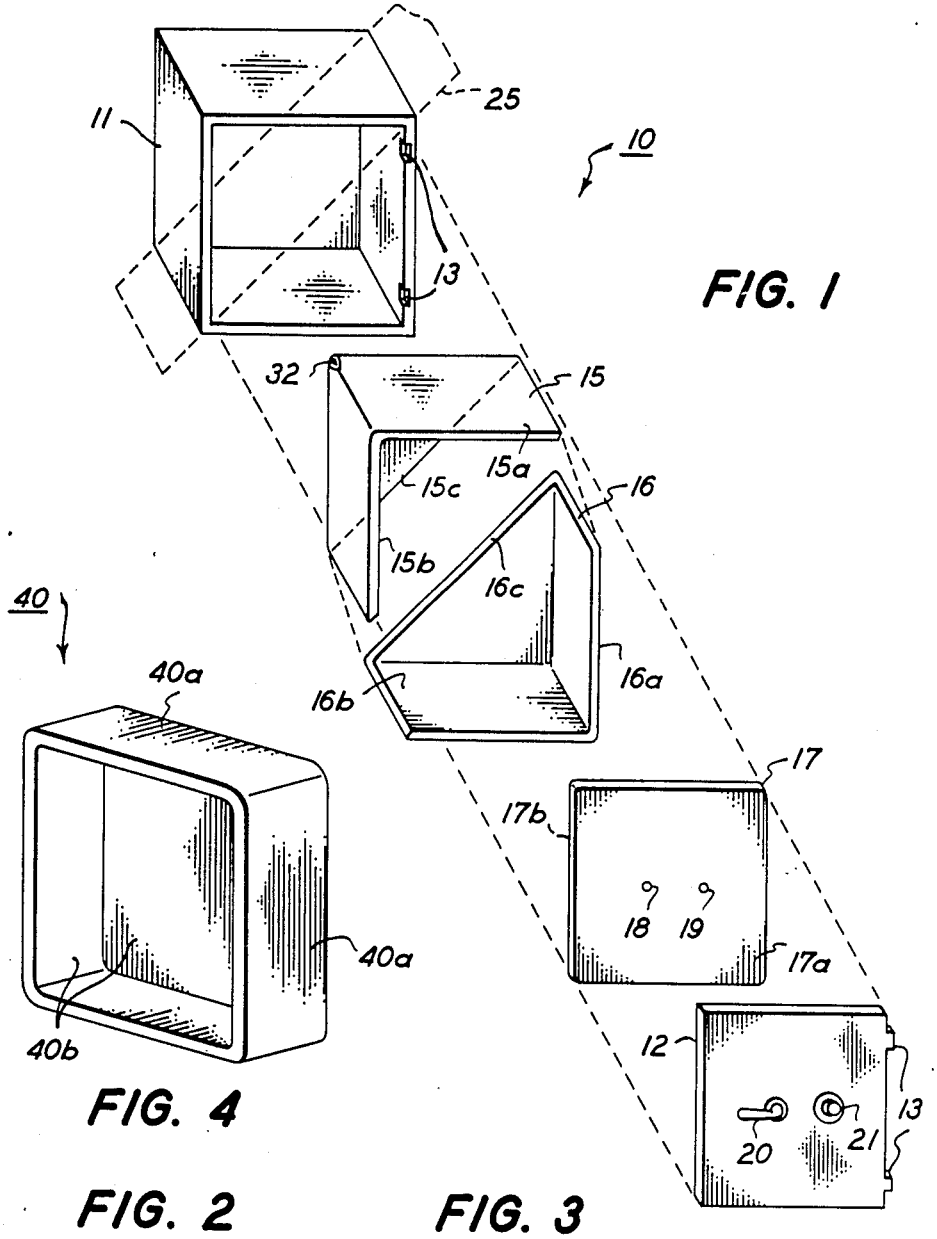
FIG. 1
FIG. 4
FIG. 2
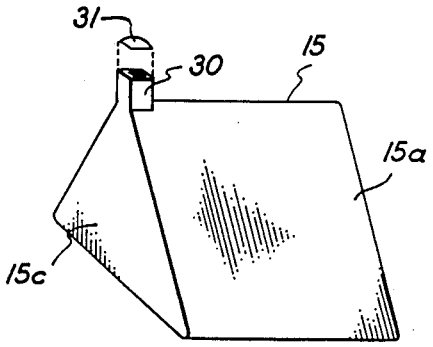
FIG. 3
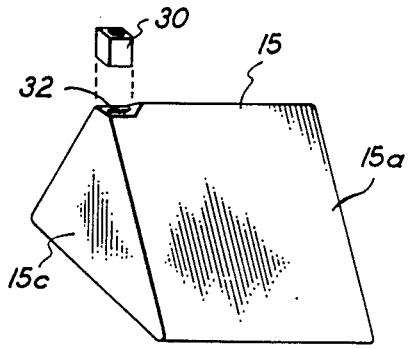

VAPOR-SEALED INSULATION SYSTEM FOR FIRE RESISTANT SAFE

BACKGROUND

Water-based insulation systems for fire resistant safes have many disadvantages that have gone unsolved throughout the decades of their use. Excess water, desirable for insulation purposes, tends to evaporate out of the insulation, reducing its effectiveness with passing years. This prevents a safe manufacturer from guaranteeing long-term fire resistance. Moisture escaping from the insulation also corrodes the steel cabinets that are necessary for the structural integrity of larger safes. The insulation material has a soupy consistency when initially poured into the safe; and it unavoidably splatters, spills, or leaks onto the safe body, from which it must be cleaned at considerable expense. The outer surfaces of steel safe cabinets cannot be finished before being filled with insulation, because spills and cleanup would mar the finish. The outer surface finish, applied after the insulation is in place, cannot be baked or cured at high temperatures, because the insulation absorbs heat. This reduces the available finish alternatives.

We have discovered that these problems can be solved by forming the insulation within vapor-tight resin molds that can later be assembled into the steel body and door cover of a fire resistant safe. The extra expense of the insulation molds is more than offset by reducing the cost of steel fabrication; eliminating insulation cleanup; allowing use of exterior finishes that are baked at high temperatures; and, most importantly, prolonging the insulation's fire resistance by sealing in its moisture.

SUMMARY OF THE INVENTION

Our insulation system applies to a fire resistant safe having a body and door each formed with a steel outer wall. We use at least one door mold and at least one body mold made of resin material formed with spaced-apart inner and outer resin walls forming a vapor-tight enclosure around an insulation cavity. We fill each of the cavities with insulation material that is vapor sealed by the resin walls, and we preshape the door and body molds to fit respectively within the outer wall of the door and body. The inner walls of the molds form the interior surfaces of the door and body of the finished safe, and the filled molds can be assembled into the body and door after external finishing. The region where the insulation was poured into its mold can be sealed over to block all vapor escape and preserve the insulation's fire resistance.

DRAWINGS

FIG. 1 is an exploded perspective view of a preferred embodiment of our insulation system;

FIGS. 2 and 3 are perspective views of a preferred mold part used in the system of FIG. 1 showing successive stages of manufacture; and FIG. 4 is a perspective view of a differently shaped body mold that can form a unitary body liner for the inventive insulation system.

DETAILED DESCRIPTION

Our insulation system 10 applies to a fire resistant safe having a steel body 11 and a steel door cover 12 providing finished outer walls and structural support. Hinges

13 mount door cover 12 on body 11, and door 12 is arranged to lock to body 11.

The thermal insulation for body 11 and door 12 is vapor sealed within resin molds shaped to fit within body 11 and door 12. Each of the insulation molds is formed of resin material to have inner and outer walls enclosing a vapor-tight mold cavity that can be filled with enough insulation material to make the safe fire resistant. One, two, or several molds each can be used for lining body 11 and door 12. The number and shapes of molds used depend in part on the shapes of the safe bodies to be lined and the technology chosen for forming the molds. We prefer blow molding, but other molding or resin-forming technology may prove effective in some circumstances.

In the embodiment of FIGS. 1–3, molds 15 and 16 are preconfigured for fitting together within body 11, and door mold 17 is shaped to fit within door cover 12. Each of the molds 15–17 has outer walls 15*a*, 16*a*, and 17*a* and inner walls 15*b*, 16*b*, and 17*b* enclosing vapor-tight insulation cavities. Door mold 17 preferably extends fully over the interior of door 12 where its inner wall 17*b* provides the interior surface for door 12. Mold 17 can be formed with through openings 18 and 19 to accommodate the spindles of a handle 20 and a lock 21 mounted on door 12.

Body liner molds 15 and 16 preferably extend over the entire inside of steel body 11 and are preferably divided along a diagonal plane 25 extending through upper and lower corners and edges of body 11. Liner molds 15 and 16 fit closely together when assembled into body 11 and are juxtaposed along respective diagonal edges 15*c* and 16*c*. The lined area within body 11 can also be divided along other lines and planes and can be separated into regions filled by more than two liner molds.

Molds 15–17 are preferably formed with input or filling tubes 30 as best shown in FIGS. 2 and 3. Cutting away closed outer ends 31 of tubes 30 opens a passageway through which insulation can be poured into the mold cavity, which is preferably overfilled so that insulation rises into tube 30. Then after the insulation has set, tube 30 and the overfilled insulation are cut away as shown in FIG. 3, leaving a small stub 32 of exposed insulation. Sealing stub 32 with a waterproof coating or paint locks all the moisture within the resin mold cavity.

Body mold 40, with its outer wall 40*a* and inner wall 40*b*, is shaped so that it can be blow molded in a single piece that can completely line the interior of a safe body 11 having a relatively shallow depth. Many other configurations are possible for safe bodies and single or multiple mold liners formed to insulate their interiors. Also, the inner mold walls forming interior surfaces for the safe can be formed to accommodate shelves, drawers, removable boxes, and compartments.

The completely sealed insulation retains its moisture and maintains its fire resistance. Also, moisture that cannot get out of the molds cannot corrode the steel body and door. Moreover, pre-casting the insulation in clean, resin molds allows a finish on the body and door to be applied before assembly and baked at high temperature if desired.

We claim:

1. A vapor-sealed insulation system for a fire resistant safe, said insulation system comprising:

a. at least one door mold and at least one body mold, each of said molds being blow molded of resin material to have spaced-apart inner and outer resin walls forming a vapor-tight enclosure around an insulation casting cavity;

b. fire resistant insulation material cast within said molds and vapor sealed within said cavities by said resin walls;

c. said door and body molds being juxtaposed so that said inner walls of said body and door molds form interior surfaces of said safe and said fire resistant insulation material within said body and door molds encloses a fire resistant shelter within said interior surfaces;

d. a steel safe body around said outer resin wall of said body mold, said steel safe body forming exterior surfaces of said safe; and e. said body mold being divided in diagonal halves.

2. The system of claim 1 including a steel wall adjacent said outer resin wall of said door mold, said steel wall forming an exterior surface of the safe door.

3. The system of claim 1 including a baked enamel finish on said exterior surfaces of said steel safe body.

4. A vapor-sealed insulation system for a fire resistant safe, said insulation system comprising:

a. at least one door mold and at least one body mold, each of said molds being blow molded of resin material to have spaced-apart inner and outer resin walls forming a vapor-tight enclosure around an insulation casting cavity;

b. fire resistant insulation material cast within said molds and vapor sealed within said cavities by said resin walls;

c. said door and body molds being juxtaposed so that said inner walls of said body and door molds form interior surfaces of said safe and said fire resistant insulation material within said body and door molds encloses a fire resistant shelter within said interior surfaces;

d. a steel safe body around said outer resin wall of said body mold, said steel safe body forming exterior surfaces of said safe; and e. an outer wall of said body mold having a filling projection for admitting and receiving over filling of said insulation material poured into said cavity, said insulation material being severed within said filling projection and sealed by a vapor-sealing material extending over said severed insulation within said filling projection.

5. The system of claim 4 including a steel wall adjacent said outer resin wall of said door mold, said steel wall forming an exterior surface of the safe door.

6. The system of claim 5 wherein said body mold is divided in diagonal halves.

7. The system of claim 5 including a baked enamel finish on said exterior surfaces of said steel safe body and said steel wall.

8. In an insulation system for a fire resistant safe, the improvement comprising:

a. fire resistant insulation material for said safe being cast and contained within molds that are blow molded of resin material forming inner and outer resin walls enclosing a vapor-tight casting cavity for said insulation material, said molds including at least one door mold and at least one body mold;

b. fire resistant insulation material cast within said molds and vapor sealed within said cavities by said resin walls;

c. said door and body molds being juxtaposed so that said inner resin walls of said body and door molds form interior surfaces of said safe and said fire resistant insulation material within said body and door molds encloses a fire resistant shelter within said interior surfaces;

d. a steel safe body and door arranged around said outer resin walls of said door and body molds, said steel safe body and door forming exterior surfaces of said safe; and e. an outer wall of each of said molds having an insulation-filling and over-filling projection within which said insulation material is severed and vapor sealed.

9. The improvement of claim 8 wherein said body mold is divided into diagonal halves.

10. The system of claim 8 including a baked enamel finish on said exterior surfaces of said steel safe body and door.

11. A fire resistant safe comprising:

a. a steel body and door forming exterior surfaces for said safe;

b. a body mold and a door mold fitting respectively within said steel body and door, each of said molds being blow molded of resin material forming inner and outer resin walls enclosing a vapor-tight casting cavity for fire resistant insulation material;

c. said fire resistant insulation material being cast within said molds and vapor sealed within said cavities by said resin walls;

d. said molds being juxtaposed so that said inner walls of said body and door molds form interior surfaces of said safe and said fire resistant insulation material within said body and door molds encloses a fire resistant shelter within said interior surfaces; and e. said body mold being divided into diagonal halves.

12. The safe of claim 11 including a baked enamel finish on said exterior surfaces of said steel body and door.

13. The safe of claim 11 wherein an outer wall of said body mold has an insulation-filling and over-filling projection within which said insulation material is severed and vapor sealed.

* * * * *

UNITED STATES PATENT AND TRADEMARK OFFICE

CERTIFICATE OF CORRECTION

PATENT NO. : 4,688,493

DATED : 25 August 1987

INVENTOR(S) : John O. Brush, Jr. and David O. Chase

It is certified that error appears in the above-identified patent and that said Letters Patent is hereby corrected as shown below:

On page 1, at Inventors, delete "Patrick J. Beattie, Henrietta" and insert --David O. Chase, Skaneateles--.

Signed and Sealed this

Twenty-second Day of December, 1987

*Attest:*

DONALD J. QUIGG

*Attesting Officer*

*Commissioner of Patents and Trademarks*